US006450216B1

(12) United States Patent
Stradella

(10) Patent No.: US 6,450,216 B1
(45) Date of Patent: Sep. 17, 2002

(54) RESERVOIR PROVIDED WITH A DEVICE FOR CLOSING AND/OR FILLING AND DEVICE FOR DISPENSING A FLUID PRODUCT COMPRISING SAME

(75) Inventor: Giuseppe Stradella, Camogli (IT)

(73) Assignee: Valois, S.A., Paris (FR)

( * ) Notice: Subject to any disclaimer, the term of this patent is extended or adjusted under 35 U.S.C. 154(b) by 0 days.

(21) Appl. No.: 09/830,344

(22) PCT Filed: Oct. 26, 1999

(86) PCT No.: PCT/FR99/02590

§ 371 (c)(1),
(2), (4) Date: Apr. 26, 2001

(87) PCT Pub. No.: WO00/24523

PCT Pub. Date: May 4, 2000

(30) Foreign Application Priority Data

Oct. 26, 1998 (FR) ..... 98 13837

(51) Int. Cl.[7] ..... B65B 1/04

(52) U.S. Cl. ..... 141/27; 141/67; 141/329; 604/203; 604/415

(58) Field of Search ..... 141/67, 329, 330, 141/27, 25, 21; 604/415, 416, 201, 202, 203

(56) References Cited

U.S. PATENT DOCUMENTS 2,475,060 A * 7/1949 Smith ..... 604/203
3,368,558 A * 2/1968 Sarnoff et al. ..... 604/198
3,841,329 A * 10/1974 Killinger ..... 604/231

* cited by examiner

*Primary Examiner*—Steven O. Douglas
(74) *Attorney, Agent, or Firm*—Sughrue Mion, PLLC

(57) ABSTRACT

A reservoir (10) containing a fluid to be dispensed, and provided with a closure and/or filling device for closing and/or filling said reservoir, said device comprising at least one closure element (20, 120, 220) acting as a leaktight closure stopper when at rest,-said at least one closure element (20, 120, 220) comprising: an annular portion (21, 121, 221) whose outside diameter corresponds substantially to the inside diameter of the reservoir (10), said annular portion (21, 121, 221) being inserted in leaktight manner in said reservoir; and a central portion (22, 122, 222) having an end wall (23, 123, 223) which closes off said reservoir (10) in leaktight manner when in the rest position; said reservoir being characterized in that said end wall (23, 123, 223) is provided with at least one slit (24, 124, 224) suitable for opening under the effect of at least a predetermined minimum pressure.

23 Claims, 6 Drawing Sheets

RESERVOIR PROVIDED WITH A DEVICE FOR CLOSING AND/OR FILLING AND DEVICE FOR DISPENSING A FLUID PRODUCT COMPRISING SAME

The present invention relates to a closure and/or filling device for closing and/or filling a reservoir, and to a dispenser device for dispensing a fluid, which dispenser device includes such a reservoir. The present invention is particularly well suited to being used in a spray device for spraying a liquid, in particular in the pharmaceuticals field.

In medication sprays, and in particular in devices in which the pump is pre-filled during packaging of the device, as applies in particular to certain single-dose or two-dose devices, certain problems need to be solved.

A first problem relates to the stability of the fluid and to contamination thereof. While it is stored, a liquid tends to evaporate and/or can be contaminated by external agents such as bacteria, or can even be oxidized by oxygen. To avoid any evaporation, it is necessary to close the reservoirs in airtight manner and to use impermeable materials for the component parts of the reservoirs To avoid any contamination, it is important to keep the number of different materials in contact with the fluid to as small a number as possible, and said materials should be inert relative to the fluid. Suitable materials for satisfying those two requirements are, for example, glass for the reservoir, and special rubbers that do not interact with the liquid for the sealing device(s).

Another problem relates to filling. The pharmaceuticals industry generally requires devices that are easy to fill and that are, if possible, capable of being assembled completely before they are filled with medication. Clearly, the handling of the medication is the most critical step as regards problems that can arise due to the surroundings, and in particular the risk of the fluid being contaminated. It is therefore important to have not only a suitable filling machine, but, above all, to protect the entire filling and assembly process effectively, which can be very complex and therefore also very costly. In addition, the possibility of having a device that is completely pre-assembled before it is filled is going to become increasingly important, in particular for the single-dose or two-dose sprays that are to serve in future use with influenza vaccines. In such a case, the fluid, e.g. the vaccine will be available only a few months (2 to 3 months) before it is used,-and millions of devices will need to be filled within a very short time. In that case, it would be very advantageous for it to be necessary merely to fill the reservoir of a device that has already been completely assembled, it being possible for such assembly to be performed at any time without it being necessary to work to such a short time constraint.

Another problem that arises relates to precompression. When sprays are used, the quality of the spray and the size of the particles depends on the pressure delivered to the liquid as it is being expelled. In order to make such devices less dependent on the actuating force delivered by the user, it is preferred to provide a system capable of delivering sufficient precompression to the liquid before it is expelled.

Currently-available technology does not make it possible to solve all of the problems, or to satisfy all of the requirements mentioned above, and only partial and complex solutions are available in the state of the art.

Thus, devices have been proposed in which a membrane of any shape, material, or type is fixed over the opening of the reservoir, said membrane being designed to be broken or torn by a suitable device when the spray is actuated. That solution makes it possible to solve the problem of the stability of the fluid contained in the receptacle, but it suffers from the drawbacks of being relatively costly because the operation of assembling the membrane onto the reservoir is quite complex. In addition, filling is necessarily performed before the reservoir is assembled in the device, and fixing the membrane requires substances, such as plastics materials, to bond or glue the membrane, and such substances can cause problems related to contaminating the fluid. In addition, no precompression is provided by that type of closure system.

In another solution disclosed by Document FR-2 684 304, when the device is actuated, a rubber stopper which also serves as a pump piston is pierced by a hollow needle which is connected to the spray nozzle of the device. That solution makes it possible to solve the problem of the stability and of the contamination of the fluid contained in the reservoir because it uses only glass and rubber, but it does not make it possible to overcome the problem related to filling the reservoir after it has been assembled. The reservoir must be filled separately before final assembly of the reservoir. Furthermore, no precompression is provided by that system because the rubber offers very little resistance to penetration by the needle. In addition, in some cases, the piercing provided by the needle can remove small particles of rubber that can obstruct the spray or that can be ejected into the user's nasal cavity. Moreover, although the device is relatively simple to close, it is complex to open, it requires a plurality of components, and is difficult to handle, in particular because of the presence of a needle.

Document U.S. Pat. No. 3,841,329 discloses a syringe provided with a stopper suitable for forming the dispensing piston when the syringe is actuated. That piston-cum-stopper is provided with a slit that opens when the syringe is actuated. No precompression is provided since the slit acts merely as a valve.

An object of the present invention is to provide a closure and/or filling system for a reservoir, in particular serving to be used in a spray device, which system does not suffer from the above-mentioned drawbacks.

Thus, an object of the invention is to provide a reservoir that has a simple and effective closure system which is opened by the pressure that is generated inside the reservoir when it is actuated, without needing a complex opening system that removes or pierces or withdraws portions of components.

An object of the present invention is also to provide such a reservoir that is simple and inexpensive to manufacture and to assemble.

An object of the present invention is also to provide a closure and/or filling system that makes it possible to use as few materials as possible in contact with the fluid contained in the reservoir, and in particular glass for the reservoir, for the closure element, rubber characterized by being inert relative to the fluid.

An object of the present invention is also to provide a closure and filling system for a reservoir, which system can be used as a liquid inlet for easy and fast filling, it being possible, in particular, for filling to be performed prior to complete final assembly of the fluid dispenser device that incorporates the reservoir.

An object of the present invention is also to provide a closure and/or filling system that opens to enable the liquid to be expelled only if a predetermined and sufficiently high pressure is generated when actuating a reservoir, so that the liquid is expelled with a certain amount of precompression. This is particularly advantageous for a spray system.

An object of the present invention is also to provide a reservoir provided with a closure and filling device and that satisfies all of the above requirements simultaneously, i.e. it guarantees the stability of the fluid contained in the reservoir, it prevents the fluid from being contaminated by chemical interaction, it enables the reservoir to be filled quickly and simply, in particular after final assembly of the device, and it guarantees that the fluid is expelled with precompression that can be predetermined.

The present invention thus provides a reservoir for a fluid spray, said reservoir containing a fluid to be dispensed, and provided with a closure and/or filling device for closing and/or filling said reservoir, said device comprising at least one closure element acting as a leaktight closure stopper when at rest, said at least one closure element comprising:

an annular portion whose outside diameter corresponds substantially to the inside diameter of the reservoir, said annular portion being inserted in leaktight manner in said reservoir; and a central portion having an end wall which closes off said reservoir in leaktight manner when in the rest position;

said reservoir being characterized in that said end wall is provided with at least one slit suitable for opening under the effect of at least a predetermined minimum pressure, so that the fluid is dispensed with predetermined precompression that is sufficient to provide a good spray of fluid, said predetermined pressure threshold being defined by the geometrical shape of said end wall and/or by the thickness of said end wall and/or by the characteristics of the material of said end wall and/or by the dimensions of said slit.

Advantageously, said central portion of said at least one closure element is provided with an axial bore that is closed at one end by said end wall which is made of an elastically-deformable material, and said slit opens by means of said end wall being deformed in response to at least a predetermined minimum pressure being exerted on it.

Advantageously, said closure element is suitable for receiving the end of an actuating member for actuating a dispenser device for dispensing fluid, said actuating member being provided with a fluid expulsion channel and said end of the actuating member being made to be concave so that, under the effect of a predetermined pressure generated inside the reservoir when said actuating member is actuated, said end wall of the closure element deforms towards the outside of the reservoir, into said concave end, thereby opening the slit, and dispensing the fluid contained in the reservoir through said expulsion channel and with precompression.

Advantageously, the actuating member is provided with a shoulder that co-operates with an abutment zone of said closure element so as to transmit the actuating force and so as to move said closure element in said reservoir for the purpose of dispensing the fluid in the reservoir, with precompression.

In a variant embodiment, at least said closure element is suitable for receiving a filling fitting for filling the reservoir with the fluid before or after it is assembled in a dispenser device for dispensing fluid.

Advantageously, said filling fitting is provided with a filling tube which, by exerting a certain amount of pressure on said end wall, deforms it towards the inside of the reservoir so as to pass through said slit as open.

Advantageously, said filling fitting is provided with a radial flange co-operating with the closure element and with the wall of the reservoir so that the pressure exerted by the tube to enable it to pass through the slit does not displace said closure element inside the reservoir.

In a preferred variant embodiment, the closure and/or filling device comprises a first closure element acting as a leaktight closure stopper when in the rest position and as a piston while the fluid is being dispensed, and a second closure element acting as a leaktight closure stopper and/or as a filling element.

Advantageously, a hollow rigid member is disposed in said bore in said second closure element and is suitable for receiving a filling fitting for filling the reservoir, which fitting is provided with a filling tube which, by exerting a certain amount of pressure on said end wall, deforms said end wall towards the inside of the reservoir so as to pass through said slit as open.

Advantageously, said hollow rigid member is provided with a radial flange co-operating with the second closure element and with the wall of the reservoir so that the pressure exerted by the tube to pass through the slit does not displace said second closure element inside the reservoir.

In another variant embodiment, the reservoir is further provided with a third closure element disposed in * fixed manner between the first and second closure elements, said third closure element separating the reservoir in leaktight manner into two sub-reservoirs, each sub-reservoir containing a different fluid, e.g. a powder and a liquid, and said second closure element further acting as a piston to mix the two fluids in one of the sub-reservoirs.

Advantageously, the third closure element is provided with a hollow rigid member which is inserted in its central bore, which makes it possible to open the slit in the end wall under the effect of at least a minimum pressure generated in one of the sub-reservoirs, and which prevents such opening under the effect of a pressure generated in the other sub-reservoir.

Preferably, when the filling tube of the filling fitting passes through said slit, it opens said slit so that an opening is formed around said tube, thereby enabling air to escape as the reservoir fills with the fluid.

The present invention also provides a fluid spray, said fluid spray comprising an actuating member and a reservoir.

Preferably, the reservoir is made of glass, and the closure element(s) is/are made of a substance that is inert relative to the fluid contained in the reservoir, and said fluid is sprayed finely and with precompression each time the device is actuated.

These and other characteristics and advantages of the present invention appear more clearly from the following detailed description of embodiments of the present invention given by way of non-limiting example and with reference to the accompanying drawings, in which.

Figure 1:
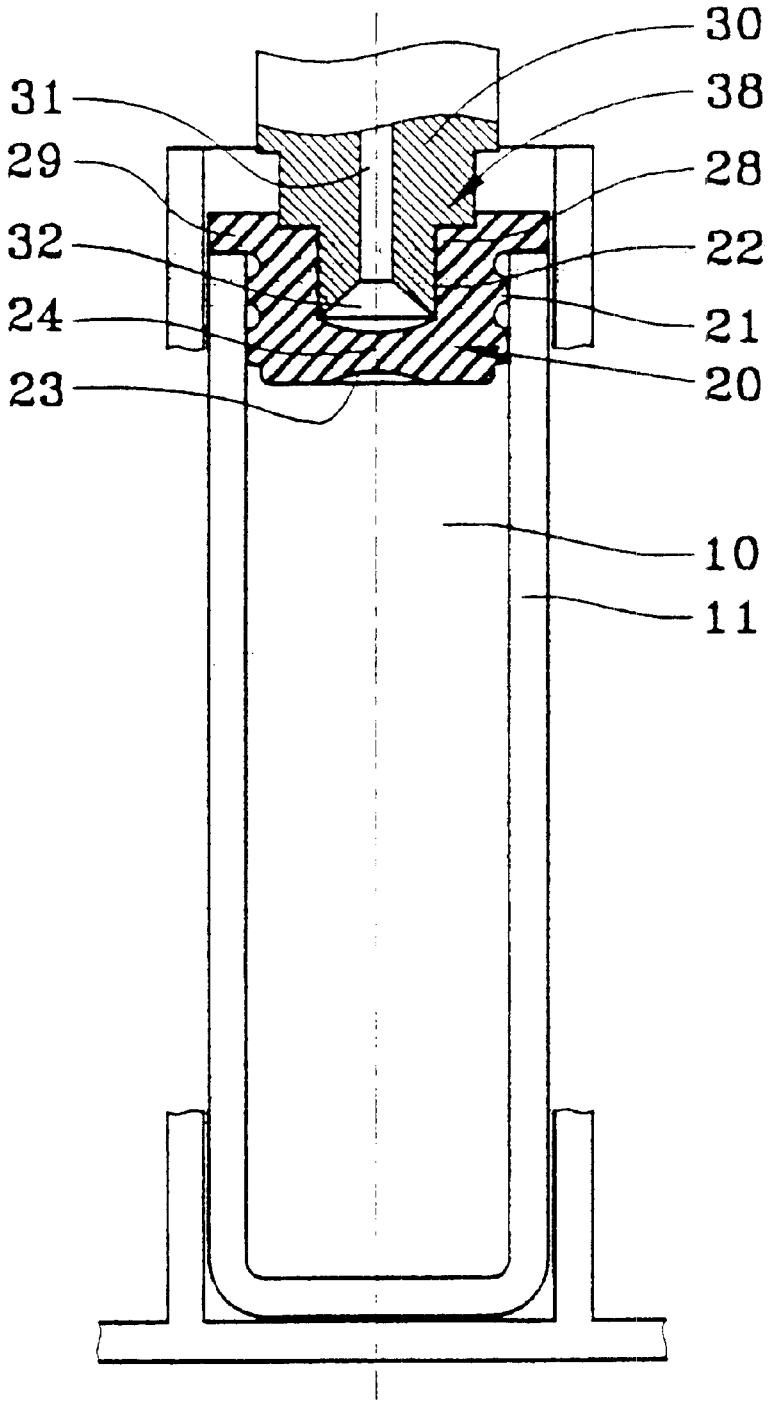
FIG. 1 is a diagrammatic section view of a reservoir provided with a closing and filling device in a first embodiment of the invention, shown in the closed position.
Figure 2:
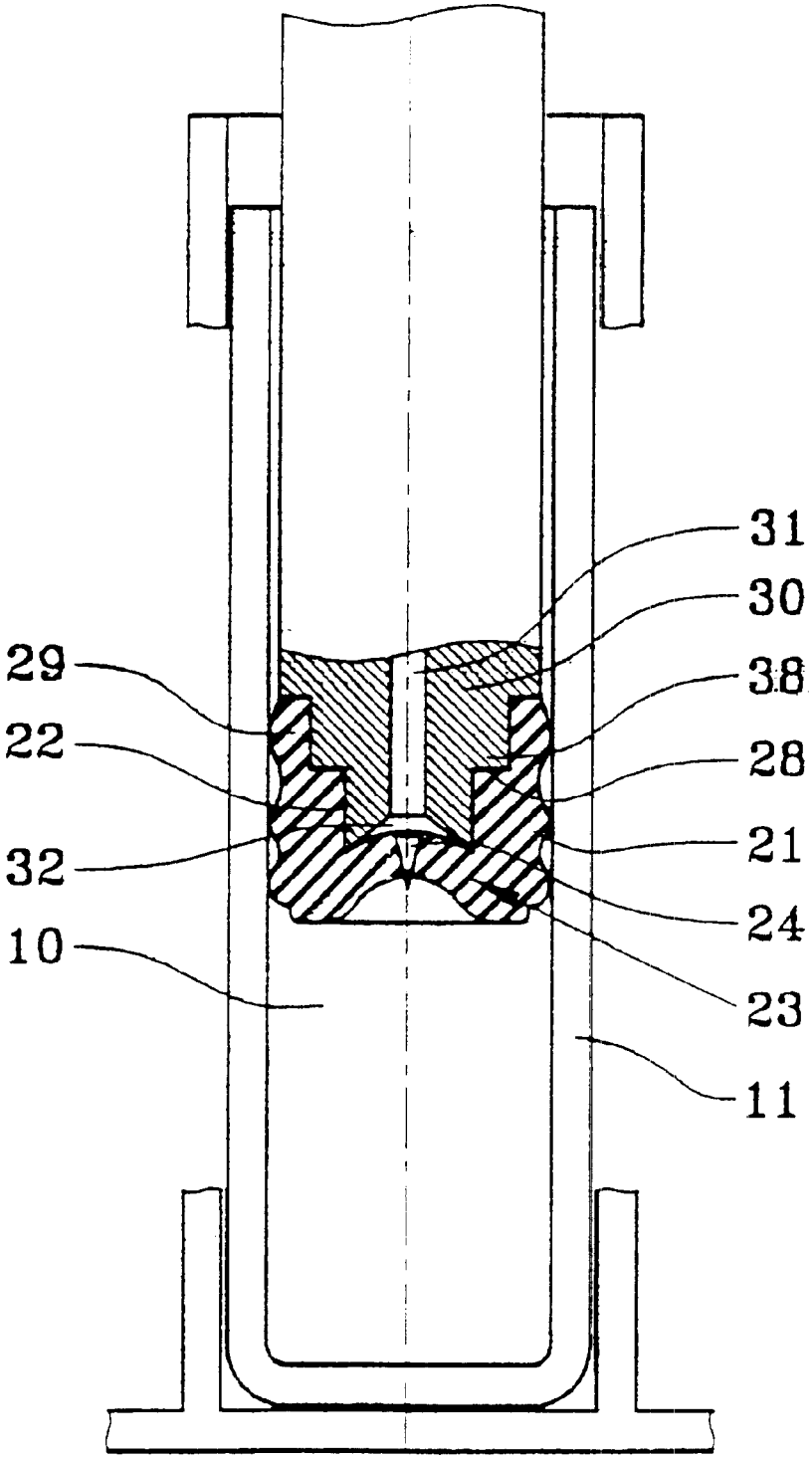
FIG. 2 is a view similar to FIG. 1, in the dispensing position.
Figure 3A:
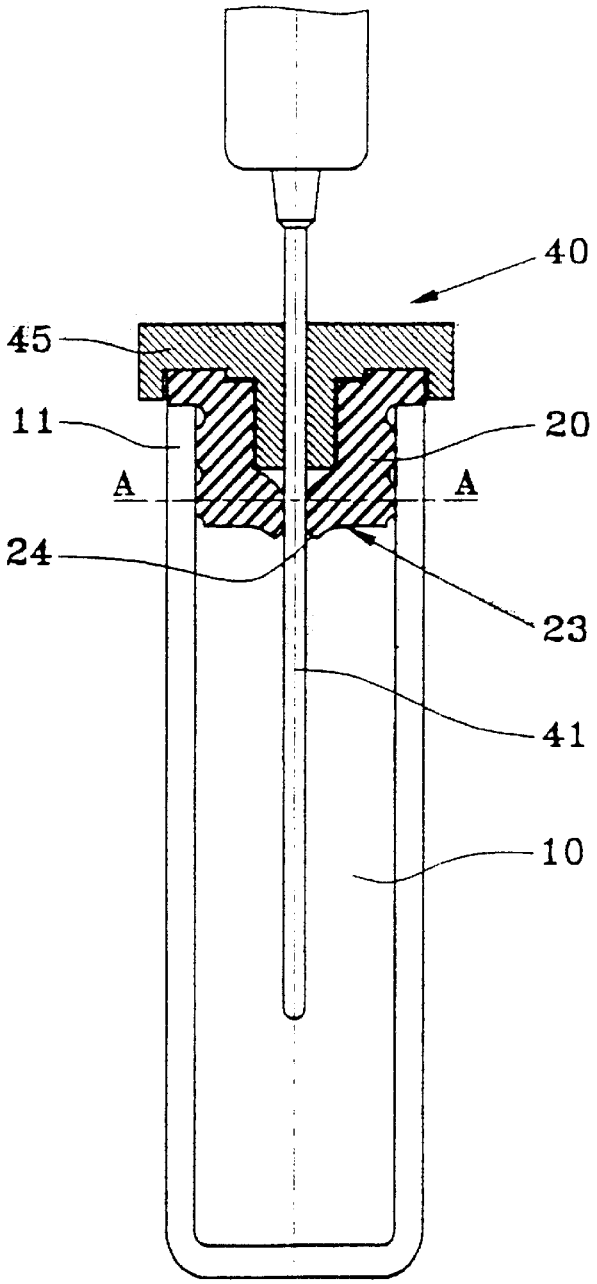
Figure 3B:
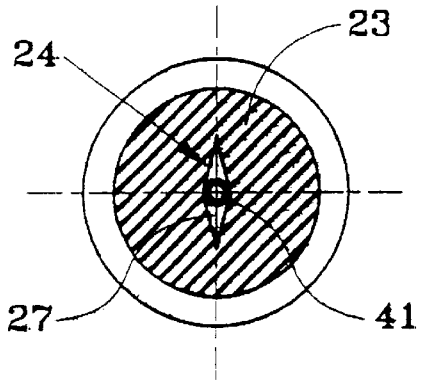

FIG. 3*a* is a diagrammatic section view of the device of FIGS. 1 and 2, in the filling position;

FIG. 3*b* is a diagrammatic cross-section view on line A—A of FIG. 3*a;*

Figure 4:
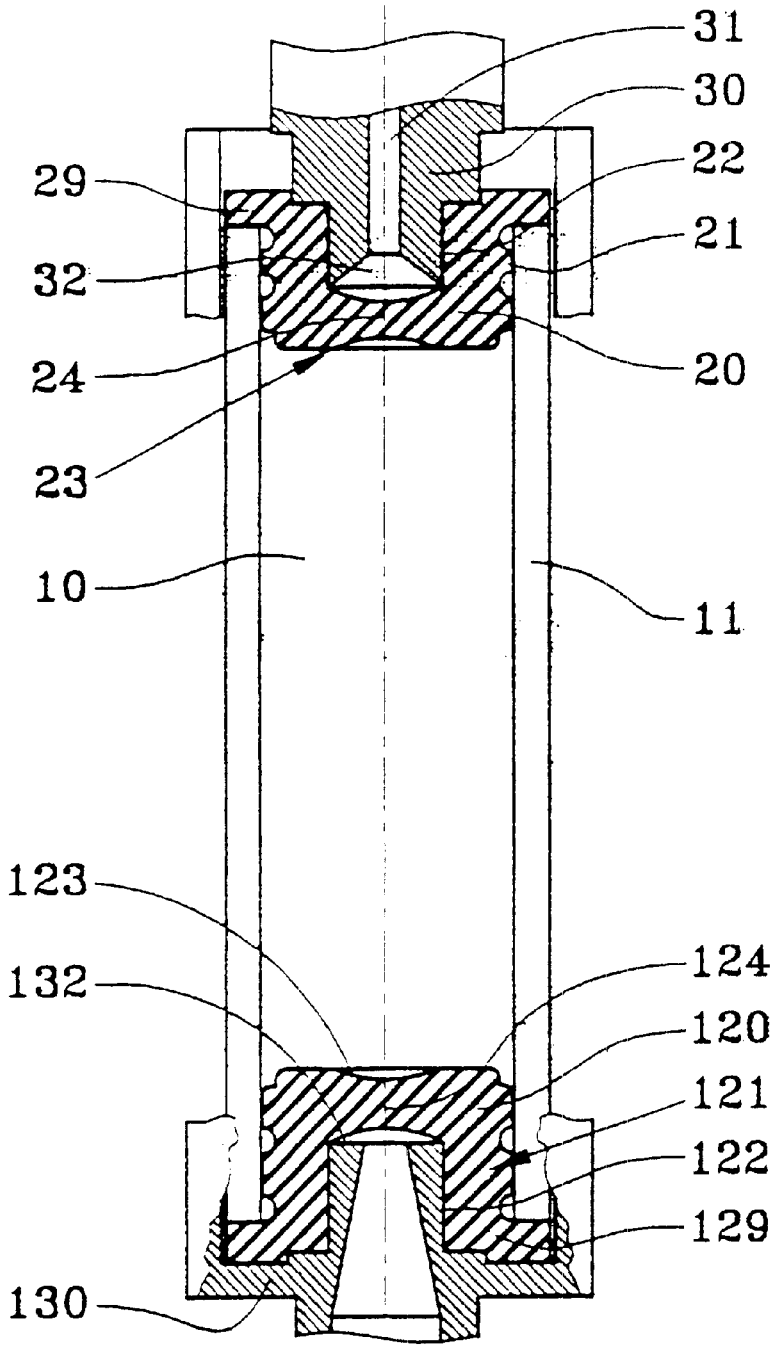
Figure 5A:
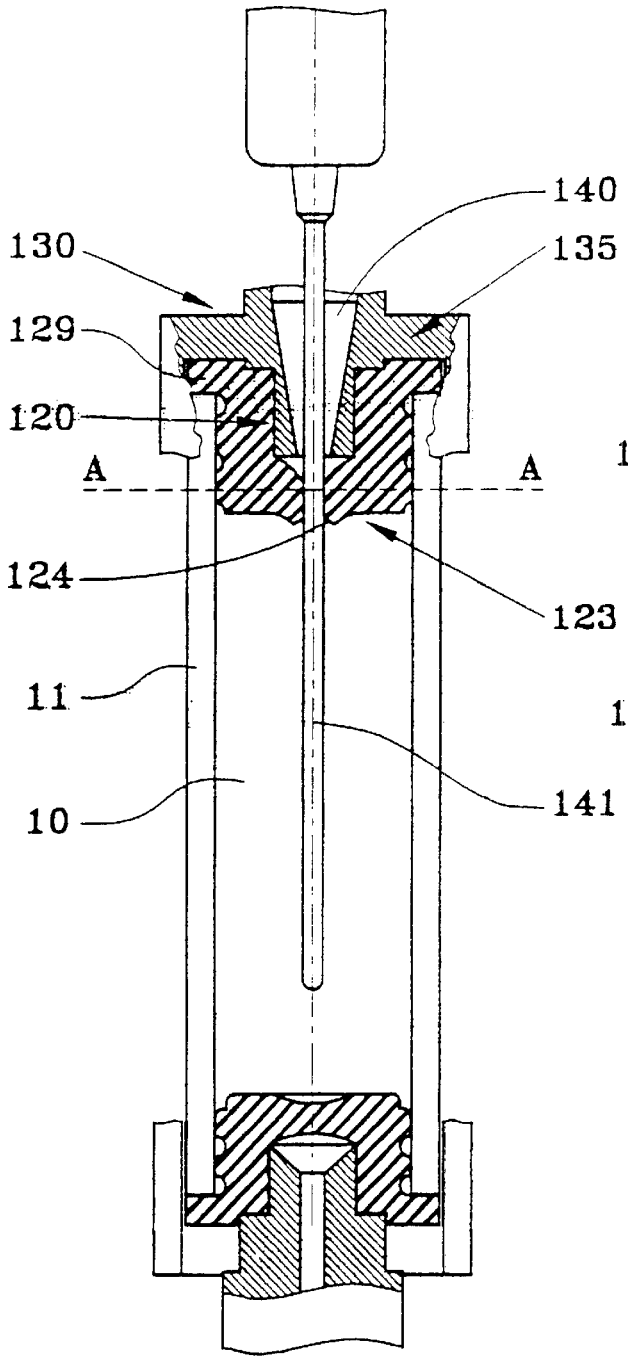
Figure 5B:
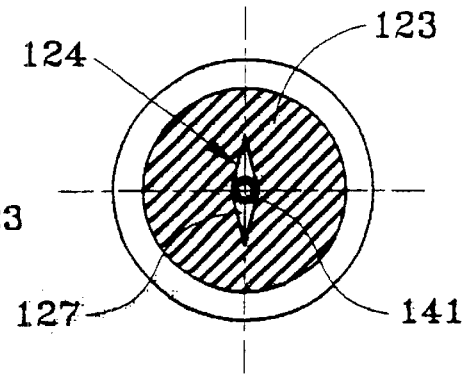
Figure 6:
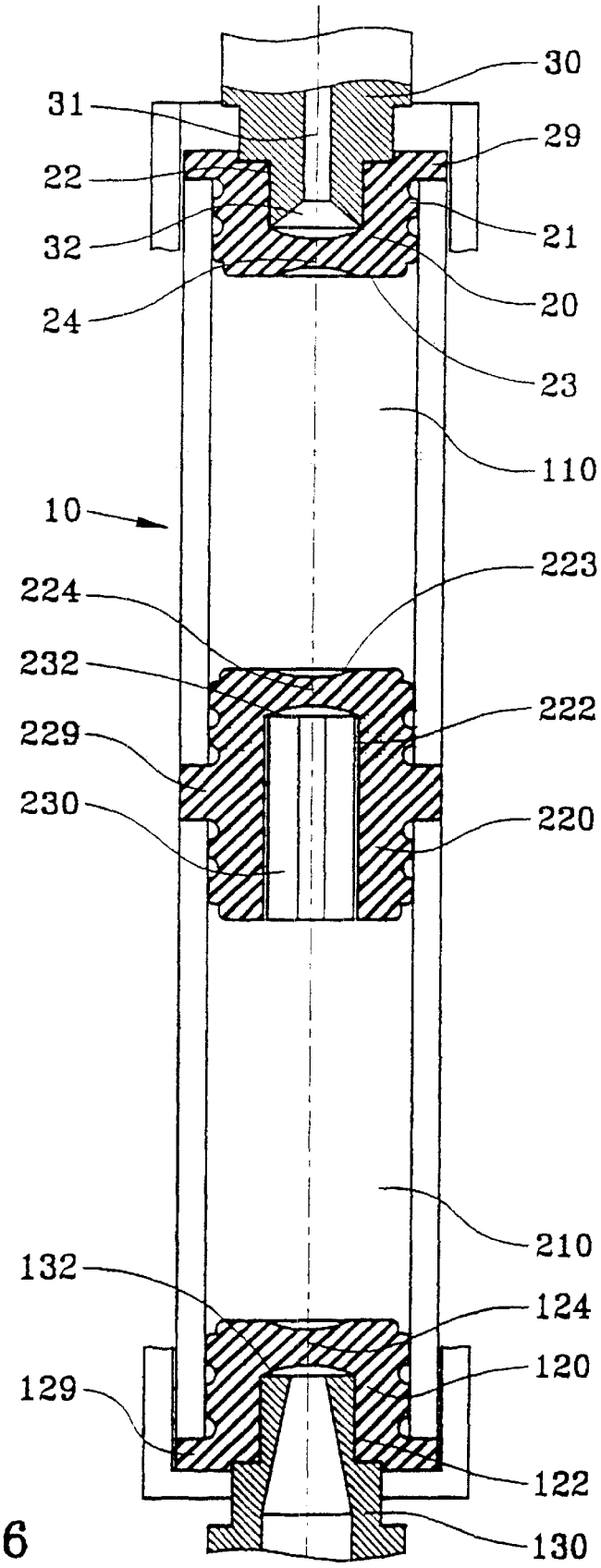

FIG. 4 is a diagrammatic section view of a reservoir provided with a closing and filling device in a second embodiment of the present invention, shown in the closed position;

FIG. 5*a* is a diagrammatic section view of the device of FIG. 4, shown in the filling position;

FIG. 5*b* is a diagrammatic cross-section view on line A—A of FIG. 5*b*; and FIG. 6 is a diagrammatic section view of a reservoir provided with a closing and filling device in another variant embodiment of the present invention, shown in the closed position.

Although it is particularly suitable for sprays for spraying liquid medication, the present invention is applicable to all fluid sprays. Only elements relating to the present invention are shown in the drawings and described in the following detailed description, and the other component parts of the devices for dispensing fluids may be of any known type, and they are neither shown nor described below.

FIGS. 1 to 3 show a first variant embodiment of the closing and/or filling device for a reservoir of the present invention. In this variant, the reservoir 10, whose walls 11 are preferably made of glass, is provided with only one opening which is closed off by a closing and filling device of the invention. This closing and/or filling device is provided with a closure element 20 which acts as a leaktight closure stopper when it is in the rest position, as shown in FIG. 1. This closure element 20 is made up of an annular portion 21 whose outside diameter corresponds substantially to the inside diameter of the reservoir 10, and of a central portion 22 making it possible to close off the reservoir in leaktight manner when it is in the rest position. The central portion 22 is provided with an end wall 23 which is provided with one or more slits 24 suitable for opening up under the effect of at least a predetermined minimum pressure. Advantageously, as shown in FIG. 1, the closure element 20 is provided with an axial bore 22 which is closed at one end by said end wall 23, and said end wall is preferably made of an elastically-deformable material. Advantageously, the closure element 20 as a whole is made of the same material, thereby making it easier manufacture. In the variant embodiment shown in FIGS. 1, 2, and 3, the closure element 20 acts as a leaktight closure stopper when it is in the rest position (FIG. 1), as a piston during dispensing of the liquid (FIG. 2), and optionally as a filling element while the reservoir 10 is being filled with the liquid (FIGS. 3*a* and 3*b*).

In the rest position, leaktightness is provided by the end wall 23 of the closure element 20, the slit 24 in said end wall being held closed in leaktight manner by the pressure exerted by the walls 11 of the reservoir 10 on the annular portion 21 and the end wall 23 of the closure element 20. The closure element is also advantageously provided with a radial flange 29 which extends the top edge of the reservoir 10 outwards so as to form an abutment to prevent any accidental displacement of the closure element 20 inside the reservoir 10.

For the purpose of dispensing the fluid, the central bore 22 in the closure element 20 is suitable for receiving the end 32 of an actuating member 30 for actuating the fluid dispenser device (not shown) and via which the actuating force exerted by the user on said actuating member 30 is transmitted to the closure element 20.

Said end 32 of the actuating member 30 co-operates with the central bore 22 (advantageously with an abutment zone 28 of said closure element 20) via a shoulder 38 of the actuating member 30, so as to transmit said actuating force. Preferably, as shown in FIG. 2, the end 32 of the actuating member 30 has a concave shape so that the end wall 23 can deform inside said concave end 32 so as to enable the slit 24 to be opened. Thus, with reference to FIG. 2, which shows the device during dispensing, when the user exerts pressure on the actuating member 30, said pressure is transmitted to the closure element 20. The pressure thus increases inside the reservoir 10 until the predetermined minimum threshold is reached that causes the end wall 23 to deform towards the concave portion of the end 32 of the actuating member 30, thereby causing the slit 24 to open. Simultaneously, the radial flange 29 on the closure element 20 folds up along the actuating rod 30 under the effect of the force released by the slit 24 opening, so that the closure element 20 is transformed into a piston mounted to slide inside the walls 11 of the reservoir 10, which then forms the pump body. The precompression achieved by the closure element 20 guarantees that the fluid contained in the reservoir is expelled from the reservoir at optimum pressure.

The closure element 20 then acts as a piston and is moved towards the bottom of the reservoir 10 so as to expel the fluid contained therein out through the slit 24 and through an expulsion channel provided in the actuating head 30. The precompression threshold necessary to deform the end wall 23 and to open the slit 24 may be determined by choosing an appropriate thickness and/or geometrical shape for said end portion 23. In particular, as shown in FIG. 1, the geometrical shape of the end wall 23 is such that it forms a curved surface, in particular a concave surface on that side which faces towards the actuating rod 30. This concave shape provides resistance to deformation which makes it possible for the pressure threshold necessary to open the slit 24 to be defined accurately. Once this threshold has been reached, the slit opens instantaneously by reversing its curvature suddenly, as shown in FIG. 2. Similarly, said end wall 23 may be provided either with a longitudinal slit 24, as shown in FIG. 3*b*, or with two or more slits disposed in a cross-shaped configuration or in any other appropriate pattern.

In FIGS. 3*a* and 3*b*, the closure element 20 of the device of FIGS. 1 and 2 is shown in the filling position. In this embodiment, filling is performed through the same closure element 20 that serves as a closer stopper in the rest position, and as a piston during dispensing. In this case, filling must generally be performed prior to final assembly of the dispenser device for dispensing fluid, in which device the reservoir is fitted. However, the reservoir is closed automatically as of the end of filling by the slit 24 closing after the filling tube has been removed.

To perform the filling, a filling fitting 40 is fitted into the central bore 22 of the closure element 20, said filling fitting 40 including a radial flange portion 45 that co-operates with the flange 29 on the closure element 20 and with the wall 11 of the reservoir 10, as shown in FIG. 3*b*. The filling fitting further includes a filling tube 41 which presses on the outside of said end wall 23 to deform it, to open said slit 24, and to penetrate into the reservoir 10. As shown diagrammatically in FIG. 3*b*, it can be seen that the filling tube 41 penetrating through the slit 24 forms side openings 27 around said filling tube 41, thereby enabling the air contained in the reservoir to escape while said reservoir is being filled. The radial flange 45, which co-operates both with the closure element 20 and with the wall 11 of the reservoir, prevents the closure element 20 from being displaced inside the reservoir while the force is being applied to the end wall 23 to deform it in order to enable the filling tube 41 to penetrate through it.

This first variant of the present invention which includes only a single closure element 20 that acts as a closure stopper, as a piston, and as a filling element makes it possible to solve all of the above-mentioned problems, except that generally it does not allow the reservoir to be filled once the dispenser device for dispensing the fluid has been finally assembled.

To satisfy this requirement, the present invention advantageously provides a second closure element 120 which is disposed at the other end of the reservoir 10 and which acts both as closure stopper and as filling element to enable the reservoir to be filled even after it has been assembled in the dispenser or spray device. The closure element 120 is implemented similarly or preferably identically to the closure element 20, i.e. it has an annular portion 121 and a central portion 122 preferably provided with a central bore 122 that is closed off at one end by a deformable end wall 123 which incorporates a slit 124 that can open under the effect of a predetermined force. Preferably, a hollow rigid member 130 is disposed in said bore 122 in the filling element 120. The radial end wall 132 of said hollow rigid member 130 is preferably made to be flat, i.e. it is disposed facing said deformable end wall 123 while preventing said end wall from deforming towards the outside of the reservoir 10 under the effect of pressure generated inside said reservoir. Thus, proper leaktightness is guaranteed while the fluid is being dispensed via the other end of the reservoir.

Said closure element 120 thus acts as a leaktight closure stopper both in the rest position and while the fluid is being dispensed.

It also acts as a filling element to enable the reservoir to be filled. To this end, the hollow rigid element 130 is provided with a radial flange 135 that co-operates with the radial flange 129 on the filling element 120, and with the wall 11 of the reservoir 10 so as to prevent said element 120 from being displaced inside the reservoir 10 when pressure is exerted from the outside on the end wall 123, in particular during filling.

In this second variant embodiment shown in FIGS. 5*a* and 5*b*, the reservoir 10 is filled similarly to the manner in which the reservoir of the first variant shown in FIG. 3*a* is filled, except that the reservoir in the second variant embodiment can be filled when said reservoir is already assembled in the dispenser device for dispensing the fluid. The filling assembly 140, in particular the filling tube 141 is brought through said hollow rigid member 130 so as to press against the end wall 123, so as to deform it, and so as to pass through the slit 124. Since the filling element 120 is not designed to serve as a piston while the fluid is being dispensed, it can be easily accessible to the filling device even when the reservoir is already assembled in the apparatus. In the example shown in FIGS. 5*a* and 5*b*, the reservoir 10 is upside down compared with the position shown in FIG. 4, so as to enable air to escape via the openings 127 provided around the filling tube 141 in the slit 124, thereby preventing any liquid from leaking through said openings 127.

The filling element 120 is shown in FIGS. 4 and 5 in association with a filling element 20 that is described above in the context of the first variant embodiment. However, it should be understood that the invention also covers a reservoir 10 that is provided with only a single closure and filling element 120 which acts both as a leaktight closure stopper, and as a filling element for filling the reservoir, even when said reservoir is already assembled on the final device. In which case, closing the other end of the reservoir, and dispensing the fluid contained in the reservoir are not necessarily achieved by a closure element 20 as described above. However, the embodiment shown in FIGS. 4 and 5 represents the preferred embodiment because it optimally combines all of the advantages of the present invention, as they are described above.

FIG. 6 shows a third variant embodiment that is particularly well suited to a single-dose dispenser device for lyophilized medication. In this variant, the reservoir 10 is separated into two sub-reservoirs 110 and 210 by a third closure element 220 which is disposed in fixed manner inside said reservoir 10 via a radial flange portion 229. This third closure element 220 is implemented similarly to the first and second closure elements 20 and 120, and, in particular, it is provided with an annular portion 221 inserted in leaktight manner in the reservoir 10 and with a central bore 222 having an end wall 223 provided with a slit 224 suitable for opening under the effect of a predetermined pressure. In this embodiment, the sub-reservoir 110 contains a lyophilized powder, and the sub-reservoir 210 contains a liquid solvent for the lyophilized medication. The second closure element 120, which, in FIG. 6 is disposed at the bottom end of the reservoir 10, acts in this variant embodiment as a closure stopper in the rest position, and optionally as a filling element for filling the sub-reservoir 210. But it also acts as a piston to mix the lyophilized fluid with its solvent. The device is actuated in two stages. In the first stage, the liquid contained in the sub-reservoir 210 is transferred to the sub-reservoir 110 via the slit 224 provided in the end wall 223 of the third closure element 220 by exerting pressure in the sub-reservoir 210 via an actuating element (not shown) acting on the hollow rigid member 130 of the second closure element 120. Said pressure generated in the sub-reservoir 210 causes the end wall 223 to deform and the slit 224 to open so that the liquid solvent is transferred into the sub-reservoir 110 via the piston 120. Once the fluid and the solvent have mixed in the sub-reservoir 110, the resulting mixture is expelled through the expulsion channel 31 in the actuating member 30 by means of the first closure element 20 as described above with reference to FIGS. 1, 2, and 3. Advantageously, to guarantee leaktightness while the mixture is being expelled, the third closure element 220 is provided with a hollow rigid member 230 inserted in its central bore 22 and whose end 232 is made to be flat. In this way, the end wall 223 can deform towards the sub-reservoir 110 so as to enable the solvent to flow through during the first stage, but cannot deform in the other direction, when extra pressure is generated in the sub-reservoir 110 during expulsion of the mixture, thereby guaranteeing leaktightness. The rigid member 130 inserted in the central bore 122 of the second closure element 120 advantageously also has an end 132 that is made in this manner so as to avoid any leakage of solvent during the first stage, during which extra pressure is generated inside the sub-reservoir 210. In this case, the slit 124 can open inwards only, so as to allow a filling tube to pass through if necessary.

The present invention thus enables a closure and filling device for a reservoir to be made very simply, and enables it to overcome all of the above-mentioned drawbacks. The reservoir may be provided only with a single closure element, but, in the preferred embodiment, it is provided with one closure element at each end of the reservoir, the first closure element serving as a leaktight stopper in the rest position, and as a piston while the fluid is being dispensed, and the second closure element acting as a leaktight closure stopper and as a filling element, making it possible, in particular, to fill the reservoir after it has been assembled in any suitable device or spray.

The present invention is described with reference to three variant embodiments, but naturally, they are not limiting, it being possible for the person skilled in the art to make various modifications without going beyond the ambit of the present invention as defined in the accompanying claims. For example, the invention is not limited to single-dose devices. For example, stop means or the like may be provided so that the fluid contained in the reservoir is expelled by actuating the device in two or more stages.

What is claimed is:

1. A reservoir (10) for a fluid spray, said reservoir containing a fluid to be dispensed, and provided with a closure device for closing said reservoir, said device comprising at least one closure element (20, 120, 220) acting as a leaktight closure stopper when at rest, and as a piston during the dispensing of the product, said at least one closure element (20, 120, 220) comprising:

an annular portion (21, 121, 221) whose outside diameter corresponds substantially to the inside diameter of the reservoir (10), said annular portion (21, 121, 221) being inserted in leaktight manner in said reservoir; and a central portion (22, 122, 222) having an end wall (23, 123, 223) which closes off said reservoir (10) in leaktight manner when in the rest position;

said reservoir being characterized in that said end wall (23, 123, 223) is provided with at least one slit (24, 124, 224) suitable for opening under the effect of at least a predetermined minimum pressure, so that a part or the whole of the fluid contained in the reservoir (10) is first put under pressure, and then dispensed with a predetermined precompression that provides a good spray of fluid, said predetermined pressure threshold being defined by at least one of: the geometrical shape of said end wall (23, 123, 223), the thickness of said end wall (23, 123, 223), the characteristics of the material of said end wall (23, 123, 223), and the dimensions of said slit (24, 124, 224).

2. A reservoir according to claim 1, in which said central portion of said at least one closure element (20, 120, 220) is provided with an axial bore (22, 122, 222) that is closed at one end by said end wall (23, 123, 223) which is made of an elastically-deformable material, and said slit (24, 124, 224) opens by means of said end wall (23, 123, 223) being deformed in response to at least a predetermined minimum pressure being exerted on it.

3. A reservoir according to claim 1, in which said closure element (20) is suitable for receiving the end (32) of an actuating member (30) for actuating a dispenser device for dispensing fluid, said actuating member (30) being provided with a fluid expulsion channel (31) and said end (32) of the actuating member being made to be concave so that, under the effect of a predetermined pressure generated inside the reservoir (10) when said actuating member (30) is actuated, said end wall (23) of the closure element (20) deforms towards the outside of the reservoir (10), into said concave end (32), thereby opening the slit (24), and dispensing the fluid contained in the reservoir (10) through said expulsion channel (31) and with precompression.

4. A reservoir according to claim 3, in which the actuating member (30) is provided with a shoulder (38) that co-operates with an abutment zone (28) of said closure element (20) so as to transmit the actuating force and so as to move said closure element (20) in said reservoir (10) for the purpose of dispensing the fluid in the reservoir, with precompression.

5. A reservoir according to claim 1, in which at least said closure element (20, 120) is suitable for receiving a filling fitting (40, 140) for filling the reservoir with the fluid before or after it is assembled in a dispenser device for dispensing fluid.

6. A reservoir according to claim 5, in which said filling fitting (40) is provided with a filling tube (41) which, by exerting a certain amount of pressure on said end wall (23), deforms it towards the inside of the reservoir so as to pass through said slit (24) as open.

7. A reservoir according to claim 6, in which said filling fitting (40) is provided with a radial flange (45) co-operating with the closure element (20) and with the wall (11) of the reservoir (10) so that the pressure exerted by the tube (41) to enable it to pass through the slit (24) does not displace said closure element (20) inside the reservoir (10).

8. A reservoir according to claim 5, in which, when the filling tube (41, 141) of the filling fitting (40, 140) passes through said slit (24, 124), it opens said slit so that an opening (27, 127) is formed around said tube (41, 141), thereby enabling air to escape as the reservoir (10) fills with the fluid.

9. A reservoir according to claim 1, in which the closure device comprises a first closure element (20) acting as a leaktight closure stopper when in the rest position and as a piston while the fluid is being dispensed, and a second closure element (120) acting as a leaktight closure stopper.

10. A reservoir according to claim 9, in which said central portion of said at least one closure element is provided with an axial bore that is closed at one end by said end wall, which is made of an elastically-deformable material; and in which a hollow rigid member (130) is disposed in said bore (122) in said second closure element (120) and is suitable for receiving a filling fitting (140) for filling the reservoir, which fitting is provided with a filling tube (141) which, by exerting a certain amount of pressure on said end wall (123), deforms said end wall towards the inside of the reservoir so as to pass through said slit (124) as open.

11. A reservoir according to claim 10, in which said hollow rigid member (130) is provided with a radial flange (135) co-operating with the second closure element (120) and with the wall (11) of the reservoir (10) so that the pressure exerted by the tube (141) to pass through the slit (124) does not displace said second closure element (120) inside the reservoir (10).

12. A reservoir according to claim 9, in which the reservoir (10) is further provided with a third closure element (220) disposed in fixed manner between the first and second closure elements (20, 120), said third closure element (220) separating the reservoir (10) in leaktight manner into two sub-reservoirs (110, 210), each sub-reservoir (110, 210) containing a different fluid, and said second closure element (120) further acting as a piston to mix the two fluids in one of the sub-reservoirs (110).

13. A reservoir according to claim 12, in which the third closure element (220) is provided with a hollow rigid member (230) which is inserted in a central bore (222) of the third closure element, and which makes it possible to open a slit (224) in an end wall (223) of the third closure element under the effect of at least a minimum pressure generated in one of the sub-reservoirs (210), and which prevents such opening under the effect of a pressure generated in the other sub-reservoir (110).

14. A reservoir according to claim 12, wherein one of the sub-reservoirs contains a powder and the other contains a fluid.

15. A reservoir according to claim 9, wherein which the second closure element also acts as a filling element.

16. A fluid spray for spraying a fluid, said fluid spray comprising an actuating member (30) and a reservoir (10) according to claim 1.

17. A spray according to claim 16, in which the reservoir (10) is made of glass, and the closure element is made of a substance that is inert relative to the fluid contained in the reservoir, and said fluid is sprayed finely and with precompression each time the device is actuated.

18. The reservoir according to claim 1, wherein said a closure device is also configured to fill said reservoir with fluid.

19. A reservoir for a fluid spray, said reservoir comprising:

a tubular structure containing a fluid to be dispensed;

a closure device that closes said reservoir, said closure device comprising a first closure element that is a leaktight closure stopper when at rest, and that is a piston when the fluid in the reservoir is being dispensed; and wherein said first closure element comprises:

an annular portion that is inserted in leaktight manner in said tubular structure; and a central portion having an end wall that closes off said tubular structure in leaktight manner when said first closure element is in the rest position; and wherein said end wall is provided with a slit that opens under the effect of a predetermined substantially unequal pressure difference across said end wall, so that the fluid contained in the reservoir is initially pressurized by actuation of said first closure element to dispense the fluid, and then dispensed with a predetermined precompression as a result of the initial pressurization, and wherein the predetermined substantially unequal pressure difference is defined by at least one of: the geometrical shape of said end wall, the thickness of said end wall, the characteristics of the material of said end wall, and the dimensions of said slit.

20. The reservoir according to claim 19, wherein said first closure element is configured to receive a filling fitting for filling the reservoir with the fluid before and after said reservoir is assembled in a dispenser device for dispensing fluid.

21. The reservoir according to claim 19, wherein said reservoir comprises a second closure element that acts as a leaktight closure stopper.

22. The reservoir according to claim 21, wherein said reservoir comprises a third closure element disposed in a fixed manner between said first closure element and said second closure element, said third closure element separating said reservoir in a leaktight manner into two sub-reservoirs, each sub-reservoir containing a different substance, and said second closure element further acts as a piston to mix the different substances in one of the sub-reservoirs.

23. A fluid spray for spraying a fluid, said fluid spray comprising:

an actuating member;

a fluid reservoir, including:

a tubular structure containing a fluid to be dispensed;

a closure device that closes said reservoir, said closure device comprising a first closure element that is a leaktight closure stopper when at rest, and that is a piston when the fluid in the reservoir is being dispensed; and wherein said first closure element comprises:

an annular portion that is inserted in leaktight manner in said tubular structure; and a central portion having an end wall that closes off said tubular structure in leaktight manner when said first closure element is in the rest position; and wherein said end wall is provided with a slit that opens under the effect of a predetermined substantially unequal pressure difference across said end wall caused by actuation of said actuating member to move said first closure element, so that the fluid contained in the reservoir is initially pressurized by movement of said first closure element, and then dispensed with a predetermined precompression as a result of the initial pressurization, and wherein the predetermined substantially unequal pressure difference is defined by at least one of: the geometrical shape of said end wall, the thickness of said end wall, the characteristics of the material of said end wall, and the dimensions of said slit.

* * * * *